US007536133B2

(12) United States Patent
Kang

(10) Patent No.: US 7,536,133 B2
(45) Date of Patent: May 19, 2009

(54) IMAGE FORMING APPARATUS FOR DUPLEX PRINTING

(75) Inventor: Sin-kyu Kang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 105 days.

(21) Appl. No.: 11/290,500

(22) Filed: Dec. 1, 2005

(65) Prior Publication Data

US 2006/0269321 A1 Nov. 30, 2006

(30) Foreign Application Priority Data

May 30, 2005 (KR) ..... 10-2005-0045426

(51) Int. Cl.
*G03G 21/00* (2006.01)

(52) U.S. Cl. ..... 399/124; 399/401

(58) Field of Classification Search ..... 399/124, 399/364, 401, 402; 271/184, 185, 186
See application file for complete search history.

(56) References Cited

U.S. PATENT DOCUMENTS 4,855,787 A * 8/1989 Hashimoto et al. ..... 399/14
4,884,110 A * 11/1989 Tsurubuchi et al. ..... 399/402
4,949,134 A * 8/1990 Iwaki et al. ..... 399/402
4,975,738 A * 12/1990 Senma et al. ..... 355/77
5,280,331 A * 1/1994 Namiki ..... 399/124
5,384,619 A * 1/1995 Yokomizo et al. ..... 399/381
5,839,032 A * 11/1998 Yasui et al. ..... 399/124
6,564,019 B2 * 5/2003 Ahn et al. ..... 399/13
6,954,602 B2 * 10/2005 Kimizuka ..... 399/92
7,212,751 B2 * 5/2007 Kayama et al. ..... 399/21
2002/0114634 A1 8/2002 Ahn et al.
2005/0163533 A1 * 7/2005 Hashimoto et al. ..... 399/124

FOREIGN PATENT DOCUMENTS

JP 07261471 A * 10/1995
JP 10-254205 9/1998
KR 2002-16664 3/2002
KR 2003-87771 11/2003

OTHER PUBLICATIONS

Office Action Issued in Korean Patent Application No. 2005-45426 on Aug. 22, 2006.

* cited by examiner

*Primary Examiner*—Robert Beatty
(74) *Attorney, Agent, or Firm*—Stein McEwen, LLP

(57) ABSTRACT

An image forming apparatus to perform duplex printing, including a duplex printing unit selectively detached and mounted with respect to a main body thereof, a pivotable duplex printing unit cover to form a document circulation path for a recording medium, a pivotable guide, and a door openably mounted to the main body to correspond to the guide.

21 Claims, 4 Drawing Sheets

IMAGE FORMING APPARATUS FOR DUPLEX PRINTING

CROSS-REFERENCE TO RELATED APPLICATIONS

This application claims the benefit of Korean Application No. 2005-45426, filed May 30, 2005, in the Korean Intellectual Property Office, the disclosure of which is incorporated herein by reference.

BACKGROUND OF THE INVENTION

1. Field of the invention

An aspect of the present invention relates to an image forming apparatus. More particularly, an aspect of the present invention relates to an image forming apparatus for duplex printing, capable of relatively efficiently removing jam of a recording medium.

2. Description of the Related Art

General image forming apparatuses such as a copier, a printer, and a facsimile comprise an image carrying medium usually implemented by a photoconductive drum, an electrostatic-latent-image formation unit which forms an electrostatic latent image on the photoconductive drum, a developing unit which develops the electrostatic latent image formed on the photoconductive drum to a visible image by a developer, a transfer unit which transfers the visible image formed on the photoconductive image onto an intermediate transfer belt or onto a recording medium, and a fixing unit which fuses permanently the image transferred onto the recording medium by heat and pressure. With the above structure, image formation processes including formation of the electrostatic latent image, developing, transfer, and fusing are repeatedly performed.

Generally, such image forming apparatuses are equipped with a duplex printing unit capable of printing desired information respectively and sequentially on both sides of one sheet of the recording medium.

FIG. 1 schematically shows the structure of an image forming apparatus having a conventional duplex printing unit, as disclosed in U.S. Patent Publication No. 2002/0114634 A1 (Aug. 22, 2002). Referring to FIG. 1, the image forming apparatus comprises a main body 100 including therein an image formation unit 2, and a duplex printing unit 200 detachably mounted to the main body 100.

The duplex printing unit 200 comprises a door panel 210 and a cover panel 220, which face each other to form a document returning path 201 therebetween and which rotate relative to each other.

According to the above structure, the recording medium bearing an image fixed on one side thereof through a fixing unit 3 is reversed and returned through the document returning path 201 and enters the image formation unit 2 again.

The duplex printing unit 200 is separably formed from the main body 100 as aforementioned, so that when the recording medium becomes jammed (hereinafter, referred to as 'paper jam'), the recording medium may be easily removed.

However, in the above-structured conventional image forming apparatus, if the paper jam occurs before the recording medium enters the duplex printing unit 200, especially if the paper jam occurs at the fixing unit 3, a correction of the paper jam becomes relatively difficult because the main body 100 may not be opened enough to draw out the jammed recording medium.

SUMMARY OF THE INVENTION

An aspect of the present invention is to solve at least the above problems and/or disadvantages and to provide at least the advantages described below. Accordingly, an aspect of the present invention is to provide an image forming apparatus for duplex printing, capable of efficiently removing a jam of a recording medium by improving the structure of a duplex printing unit.

In order to achieve the above-described aspects of the present invention, there is provided an image forming apparatus to perform duplex printing, comprising a main body including a recording medium supply unit, an image formation unit that produces an image on a recording medium supplied through the recording medium supply unit, a fixing unit that fuses the image on the recording medium, and a discharge unit that ejects the recording medium where the image is fused by the fixing unit; a duplex printing unit removably mounted to the main body to reinsert the recording medium, on which the image is fused onto one side thereof, into the image formation unit; and a door openably mounted to one side of the main body to correspond in position to a position of the duplex printing unit, wherein the duplex printing unit comprises, a duplex printing unit cover pivotably mounted by one end thereof, a first guide pivotably mounted by one end thereof to direct the duplex printing unit cover, and a second guide to convey the recording medium, as conveyed to a document circulation path formed between the duplex printing unit cover and the first guide, to the image formation unit.

The second guide comprises a first document reversing path to convey by a predetermined distance the recording medium, having been conveyed through the document circulation path; and a second document reversing path to reinsert the recording medium, having been conveyed by the predetermined distance along the first document circulation path, in the image formation unit.

The document feeding path formed between the image formation unit and the fixing unit is substantially parallel with a bottom of the main body, the document circulation path formed by the duplex printing unit cover and the first and the second guides are substantially perpendicular to the document feeding path formed by the image formation unit and the fixing unit, and the first and the second document reversing paths are substantially parallel with the document feeding path formed by the image formation unit and the fixing unit.

The recording medium supply unit is disposed at a lower part of the main body, and the second guide is disposed at a lower part of the recording medium supply unit.

The first guide comprises a lower guide formed at the second guide; and an upper guide pivotably mounted to the lower guide.

The image forming apparatus may further comprise a reversing roller at a converging point of the first and the second document reversing paths to reverse an advancing direction of the recording medium.

The image forming apparatus may further comprise a reverse sensor at an upper stream of the converging point of the first and the second document reversing paths to detect a reversing time point of the recording medium.

The image forming apparatus may further comprise a cooling fan in the document circulation path formed proximate to the duplex printing unit cover and the first and the second guides and/or adjacent to the first and the second document reversing paths in order to reduce a temperature of the recording medium.

The cooling fan is disposed at the converging point of the first and the second document reversing paths.

The second guide has an air suction port at one side near the converging point of the first and the second document reversing paths to draw in external air, and an air exhaust port at the opposite side to discharge the external air.

According to the above-described image forming apparatus to perform duplex printing, since the duplex printing unit cover and the guides are configured rotatably, jam of the recording medium may be relatively easily removed by simply opening the duplex printing unit cover and the upper guide even before entering the duplex printing unit.

Therefore, paper jam generated in the main body may be efficiently removed without having to totally separating the duplex printing unit. As a result, systemic errors generated by misassembling of the duplex printing unit after separation may be prevented.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
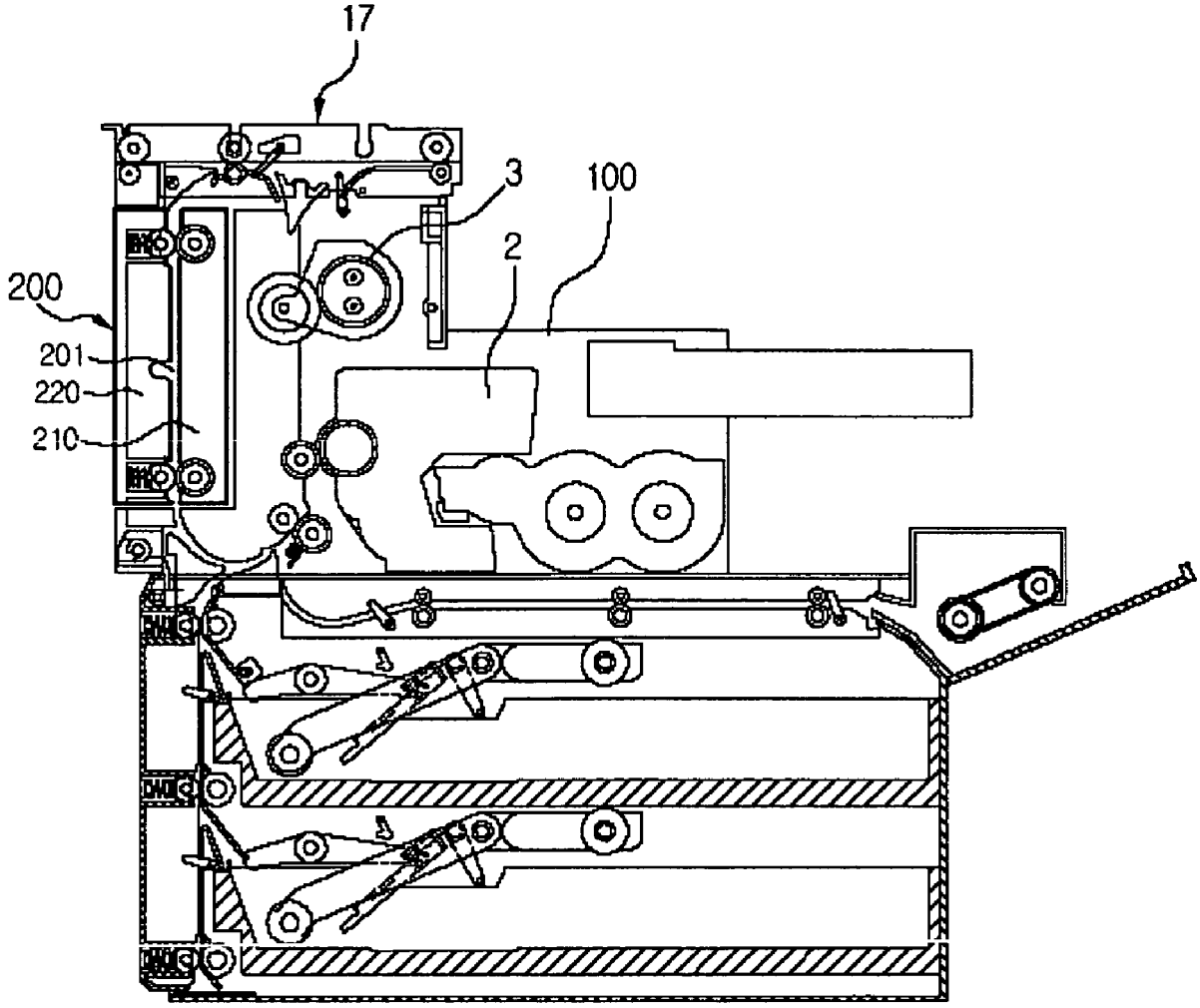
FIG. 1 (PRIOR ART)
FIG. 1 illustrates the structure of a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
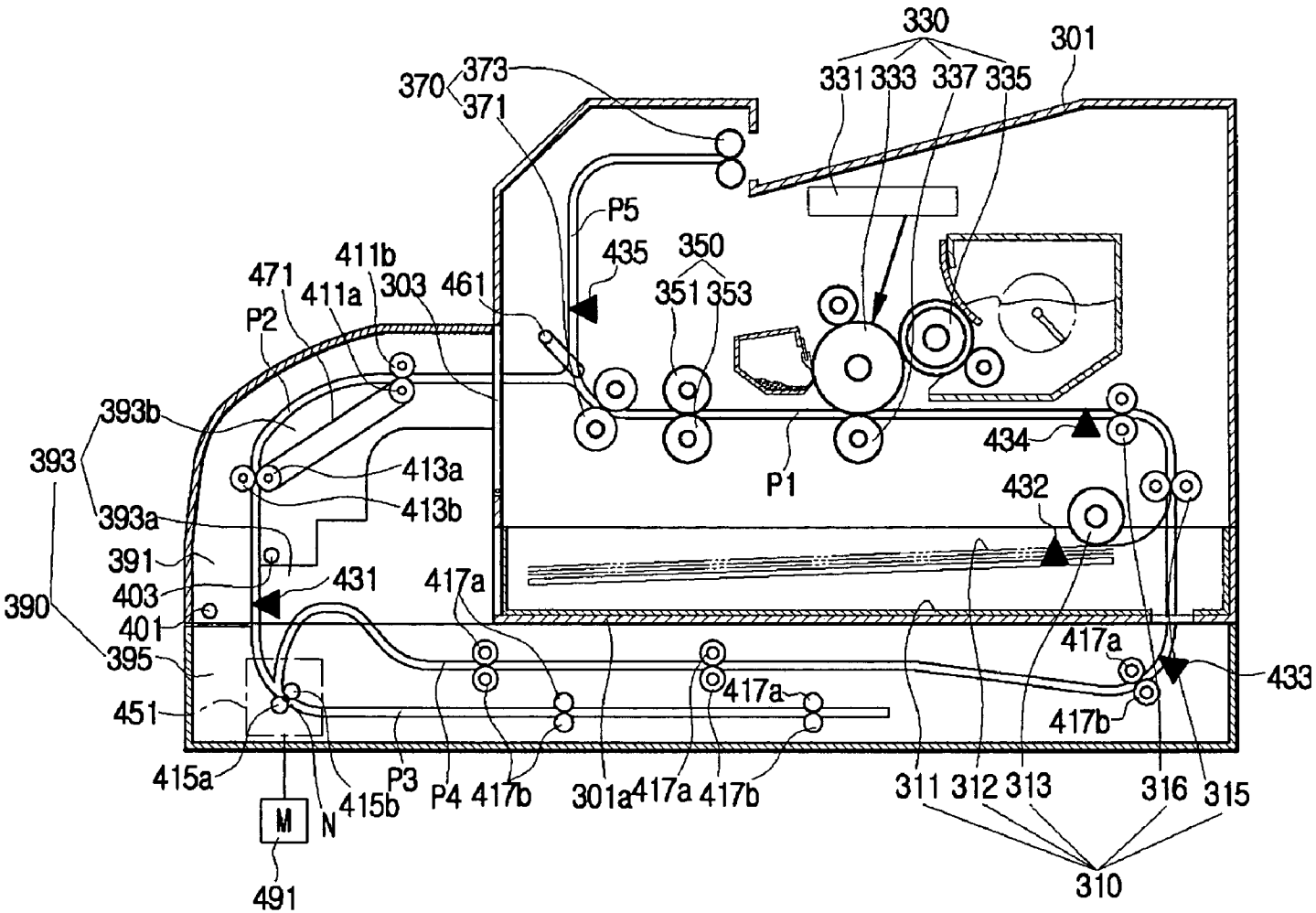
FIG. 2 is a sectional view illustrating the structure of an image forming apparatus according to an embodiment of the present invention.

FIG. 2 schematically illustrates the operation of an image forming apparatus according to an embodiment of the present invention. According to FIG. 2, an image forming apparatus 300, according to an embodiment of the present invention, comprises a recording medium supply unit 310, an image formation unit 330, a fixing unit 350, a discharge unit 370, and a duplex printing unit 390.

The recording medium supply unit 310 comprises a recording medium supply cassette 311, in which plural sheets of recording medium 312 are stacked, a pickup roller 313 to pick up the recording medium 312 from the recording medium supply cassette 311 sheet by sheet, and a plurality of supply rollers 315 and 316 to convey the picked-up recording medium 312 to the image formation unit 330.

The image formation unit 330 produces a predetermined image on the recording medium fed from the recording medium supply unit 310. For this purpose, the image formation unit 330 comprises a laser scanning unit 331, a photoconductive drum 333 where an electrostatic latent image is formed by a light projected by the laser scanning unit 331, a developing roller 335 to develop the electrostatic latent image formed on the photoconductive drum 333 into a visible image using developer, and a transfer roller 337 to transfer the visible image developed by the developing roller 335 onto the recording medium 312.

The fixing unit 350 fuses the image transferred on the recording medium 312 through the image formation unit 330 by heat and pressure. The fixing unit 350 comprises a heating roller 351 and a pressing roller 353.

The discharge unit 370 ejects the recording medium 312 bearing thereon the image fused by the fixing unit 350 to the outside of the main body 301. To this end, the discharge unit 370 comprises a plurality of discharge rollers 371 and 373.

The image formation unit 330 and the fixing unit 350 are positioned horizontally and substantially parallel with respect to a bottom 301*a* of the main body 301, such that a document feeding path P1, formed by the image formation unit 330 and the fixing unit 350, is also substantially parallel with the bottom 301*a* of the main body 301. Accordingly, a path along which the recording medium 312 travels through the recording medium supply cassette 311, the image formation unit 330, the fixing unit 350 and the discharge unit 370 up to the outside of the main body 301, substantially forms an "S" shape.

The duplex printing unit 390, as a single module, is selectively mountable to and separable from the main body 301. The duplex printing unit 390 forms a document circulation path P2, through which the recording medium 312 having an image already fixed on one side thereof is circulated through the fixing unit 350, between a printing cover 391 and a first guide 393. The printing cover 391 and the first guide 393 face each other. In addition, the duplex printing unit 390 further comprises a second guide 395, to reinsert the recording medium 312 when the recording medium is returned through the document circulation path P2 into the image formation unit 330, in contact with a lower part of the main body 301.

The duplex printing unit cover 391 and the first guide 393 are each rotatably supported at respective ends thereof by hinge shafts 401 and 403, respectively. When passing by the hinge shaft 401 and 403, the document circulation path P2 is arranged substantially perpendicularly to the bottom 301*a* of the main body 301.

A door 303 is pivotably mounted at one side of the main body 301, corresponding to the first guide 393, in order to prevent the inside of the main body 301 from being exposed to the outside when using the image forming apparatus 300 with the duplex printing unit 390 separated therefrom.

The first guide 393 is divided into a lower guide 393*a* formed at an upper surface of the second guide 395, and an upper guide 393*b* pivotably mounted to the lower guide 393*a* by the hinge shaft 403.

The second guide 395 comprises a first document reversing path P3 through which the recording medium 312 having been conveyed through the document circulation path P2 by a predetermined distance is conveyed, and a second document reversing path P4 to reverse an advancing direction of a following end of the recording medium 312 that has been conveyed by the predetermined distance along the first document reversing path P3 so as to reinsert the recording medium 312 into the image forming unit 330. The second guide 395 is laterally formed in contact with the lower part of the main body 301. The first and the second document reversing paths P3 and P4 are substantially parallel with the bottom 301*a* of the main body 301.

Consequently, the recording medium 312 is conveyed along an oval track which is longer in a lateral direction, sequentially through the document circulation path P2, the first and the second document reversing paths P3 and P4, and then the document feeding path P1.

The first guide 393 is provided with first and second feeding rollers 411*a* and 413*a* while the duplex printing unit cover 391 is correspondingly provided with first and second backup rollers 411*b* and 413*b*. A reversing roller 415*a* to reverse the advancing direction of the recording medium 312 and a reverse backup roller 415*b* are mounted at a converging point N of the first and the second document reversing paths P3 and P4. Further, a reverse sensor 431 is mounted at an upper stream of the reversing roller 415*a* and the reverse backup roller 415*b* to detect a reversing time point of the recording medium 312.

A plurality of returning rollers 417*a* and return backup rollers 417*b* that correspond to the returning rollers 417*a* are provided on the first and the second document reversing paths P3 and P4.

According to an embodiment of the invention, a cooling fan 451 to cool the recording medium 312 is provided adjacent to the first and the second document reversing paths P3 and P4 in order to prevent a deterioration of a transferring operation by heat from the recording medium 312. More specifically, the cooling fan 451 is disposed near a converging point N of the first and the second document reversing paths P3 and P4 so that the recording medium 312 may be continuously supplied with a cooling air flow.

As shown in FIG. 2, a recording medium reversing unit 461 selects between a discharge path P5 and the document circulation path P2, and a plurality of sensors 432 to 435 detects the recording medium 312 being conveyed to thereby check for an occurrence of a jam of the recording medium 312 (hereinafter, referred to as 'paper jam').

The rollers provided in the duplex printing unit 390, such as the first and the second feeding rollers 411*a* and 413*a*, the reversing roller 415*a*, and the returning roller 417*a* are transmitted with a power of a motor 491 through a belt pulley 471 or a gear train (not shown).

Figure 3:
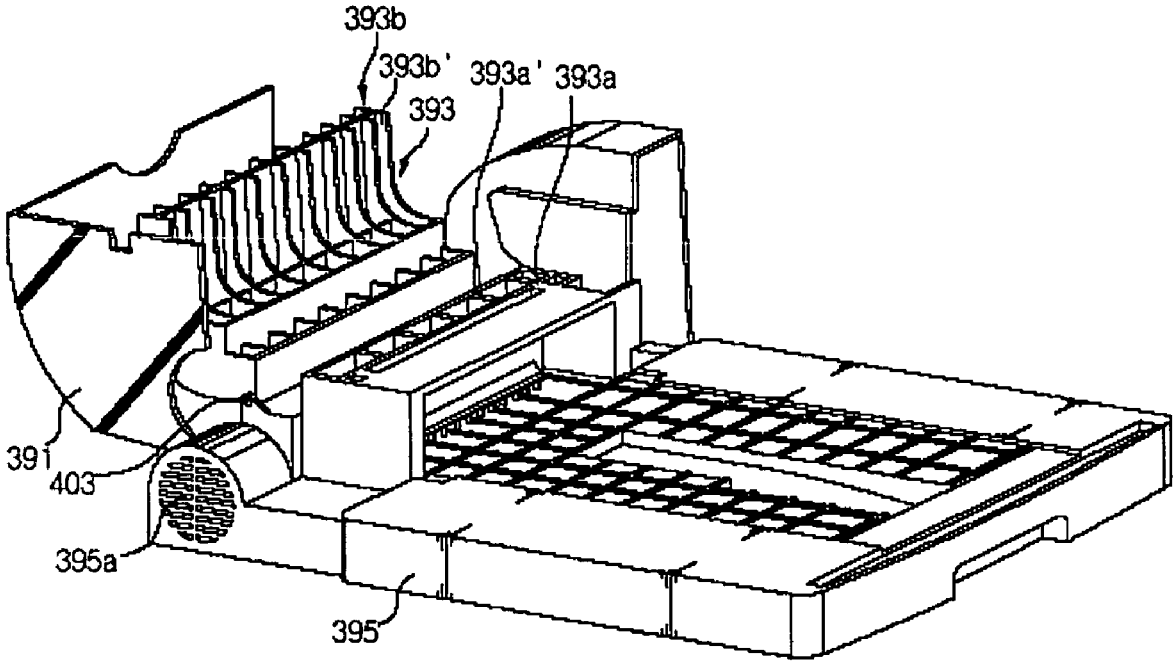
FIG. 3 is a perspective view illustrating a duplex printing unit applied to the image forming apparatus according to an embodiment of the present invention.

Hereinbelow, the operation of the duplex printing unit cover 391 and the first guide 393 will be described in greater detail with reference to FIGS. 3 and 4. FIG. 3 is a perspective view of the duplex printing unit according to an embodiment of the present invention, and FIG. 4 is a perspective view showing another side of FIG. 3.

Figure 4:
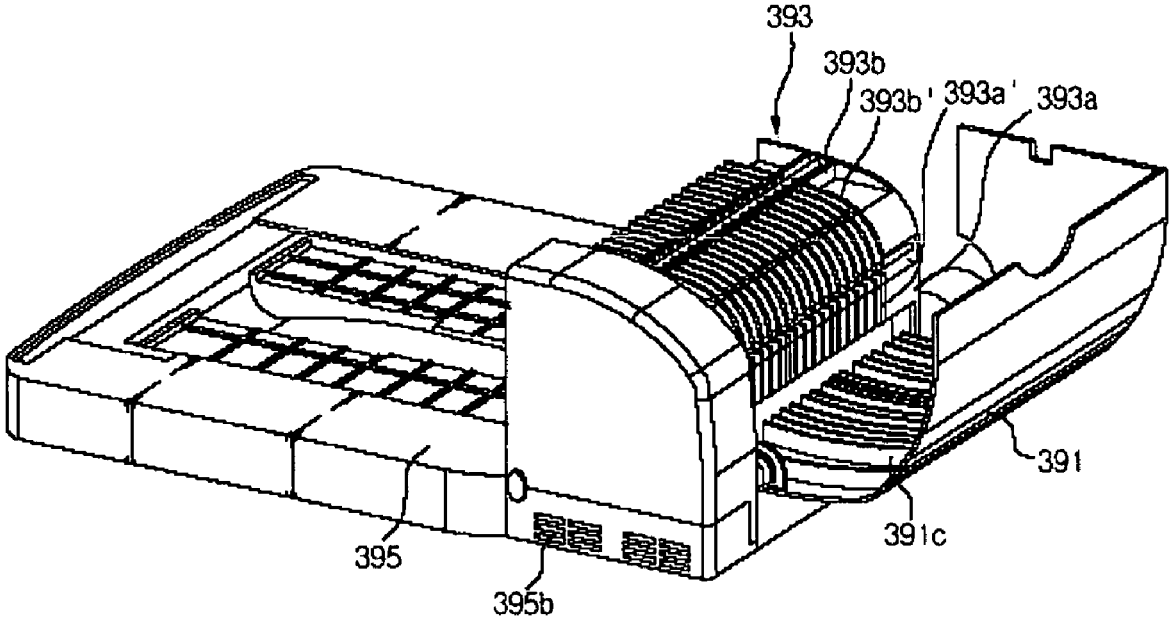
FIG. 4 is a perspective view showing another side of FIG. 3.

Referring to FIGS. 3 and 4, the duplex printing unit cover 391 is pivotably connected to one side of the second guide 395. A plurality of guide ribs 391*c* are vertically formed within the duplex printing unit cover 391. The first guide 393 comprises the upper guide 393*b* and the lower guide 393*a* respectively having a plurality of ribs, that is, lower ribs 393*a*' and upper ribs 393*b*' corresponding to the guide ribs 391*c* of the duplex printing unit cover 391. The lower guide 393*a* is integrally formed with an upper part of the second guide 395. The upper guide 393*b* is pivotably mounted to the lower guide 393*a* by the hinge shaft 403. However, the upper guide 393*b* may pivot on other parts using a dedicated member, instead of on the lower guide 393*a*.

Regarding the relative operational structure between the duplex printing unit cover 391 and the first guide 393*a*, as shown in FIGS. 3 and 4, after the duplex printing unit cover 391 is opened, the upper guide 393*b* may also be opened. Alternatively, the upper guide 393*b* may be opened in association with the duplex printing unit cover 391. However, according to an embodiment of the invention the duplex printing unit cover 391 may be opened independently.

The cooling fan 451 is provided at the converging point N of the first and the second document reversing paths P3 and P4 of the second guide 395, as shown in FIG. 2. An air suction port 395*a* through which external air is drawn in is formed on one side of the second guide 395, whereas an air exhaust port 395*b* is formed on the opposite side of the air inhaling hole 395*a*, of the second guide 35, as shown in FIG. 4.

Hereinbelow, processes of forming an image will be explained. Operations for simple printing will be described first. The recording medium 312, having been picked up by the pickup roller 201 from the recording medium supply cassette 311, is fed to the image formation unit 330 by the supply rollers 315 and 316. A toner image is transferred on one side of the fed recording medium 312 by the photoconductive drum 333 and the transfer roller 337. The transferred toner image is fused on the recording medium 312 by the heating roller 351 and the pressing roller 353 of the fixing unit 350. Then, the recording medium 312, having had a desired image formed thereon, is discharged to the outside of the main body 301 through the discharge unit 370. Here, the recording medium reversing unit 461 restricts the advancing direction of the recording medium 312 to the discharge path P5.

Next, operations for duplex printing will be described. Upon a setup of a duplex printing mode, the recording medium 312, having been passed through the simple printing processes, enters the document circulation path P2 formed between the duplex printing unit cover 391 and the first guide 393, as a result of being restricted by the recording medium reversing unit 461. The recording medium 312 is then conveyed by the first and the second feeding rollers 411*a* and 413*a* to the reversing roller 415*a*. Since high temperature of the recording medium 312 heat may cause a deterioration of an efficiency of the transferring operation, the cooling fan 451 is driven to reduce a temperature of the recording medium 312. Being disposed at the converging point N of the first and the second document reversing paths P3 and P4, the cooling fan 451 is positioned to be able to blow the external air to the first and the second document reversing paths P3 and P4 so as to improve cooling efficiency.

The recording medium 312, having been conveyed to the reversing roller 415*a*, is moved along the first document reversing path P3 of the second guide by the reversing roller 415*a* by a predetermined distance. As the following end of the recording medium 312 advances beyond a sensing range of the reverse sensor 431 by being continuously moved along the first document reversing path P3, the motor 491 rotates backwards so as to convey the following end of the recording medium 312 to the second document reversing path P4. As the advancing direction of the recording medium 312 is reversed at this point, the image-printed side of the recording medium 312 is directed upward with respect to FIG. 2.

The recording medium 312, having been conveyed to the second document reversing path P4, is then fed by the plurality of returning rollers 417*b* back to the image formation unit 330. Then the recording medium 312, having been conveyed into the main body 301, repeats the above-described image forming processes to complete the duplex printing.

Now, operations to correct a paper jam occurring especially near the duplex printing unit 390 will be explained. First, operations to remove the paper jam generated before the recording medium 312 enters the document circulation path P2 of the duplex printing unit 390 will be described. The duplex printing unit cover 391 and the upper guide 393*b* are opened sequentially. The door 303 of the main body 301 is then opened. In this state, the recording medium 312, jammed in the fixing unit 350, for example, may be drawn out. After the jammed recording medium 312 is removed, the door 303, the upper guide 393*b* and the duplex printing unit 391 may be closed in the opposite order as before.

If the paper jam is generated in the document circulation path P2 between the duplex printing unit 391 and the first guide 393, the recording medium 312 may be drawn out by opening only the duplex printing unit cover 391.

Although the document feeding path P1, formed by the image formation unit 330 and the fixing unit 350 is horizontally arranged in this exemplary embodiment, the present invention does not limit the structure so. It will be sure understood that the present invention may be applied in the conventional image forming apparatus (FIG. 1) where the image formation unit and the fixing unit are vertically arranged, with a different configuration of the second guide 395 and the first and the second document reversing paths P3 and P4.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus to perform duplex printing, comprising:

a main body including a recording medium supply unit, an image formation unit, a fixing unit, and a discharge unit;

a duplex printing unit removably mounted to the main body to reinsert the recording medium, on which an image is fused onto one side thereof, into the image formation unit during duplex printing operations, the duplex printing unit comprising:

a duplex printing unit cover pivotably mounted by one end thereof to rotate with respect to the duplex printing unit; and first and second guides to convey the recording medium, as conveyed to a document circulation path of the duplex printing unit, to the image formation unit such that the image may be printed on a second side thereof; and a door defined in one side of the main body to correspond to a position of the duplex printing unit and to open when the duplex printing unit is mounted to the main body, wherein the first guide is divided into a lower guide formed proximate to an upper surface of the second guide, and an upper guide pivotably mounted to the lower guide by a hinge shaft.

2. An image forming apparatus to perform duplex printing, comprising:

a main body including a recording medium supply unit, an image formation unit that produces an image on a recording medium supplied through the recording medium supply unit, a fixing unit that fuses the image on the recording medium, and a discharge unit that ejects the recording medium where the image is fused by the fixing unit;

a duplex printing unit removably mounted to the main body to reinsert the recording medium, on which the image is fused onto one side thereof, into the image formation unit; and a door openably mounted to one side of the main body to correspond in position to a position of the duplex printing unit, wherein the duplex printing unit comprises:

a duplex printing unit cover pivotably mounted by one end thereof;

a first guide pivotably mounted by one end thereof to direct the recording medium toward the duplex printing unit cover; and a second guide to convey the recording medium, as conveyed to a document circulation path formed between the duplex printing unit cover and the first guide, to the image formation unit, wherein the second guide comprises:

a first document reversing path to convey, by a predetermined distance, the recording medium, having been conveyed through the document circulation path; and a second document reversing path to reinsert the recording medium, having been conveyed by the predetermined distance along the first document reversing path, into the image formation unit.

3. The image forming apparatus of claim 2, wherein a document feeding path formed between the image formation unit and the fixing unit is substantially parallel with a bottom of the main body.

4. The image forming apparatus of claim 3, wherein the document circulation path is substantially perpendicular to the document feeding path.

5. The image forming apparatus of claim 4, wherein the first and the second document reversing paths are substantially parallel with the document feeding path.

6. The image forming apparatus of claim 5, wherein the recording medium supply unit is disposed at a lower part of the main body, and the second guide is disposed below the recording medium supply unit when the duplex printing unit is mounted to the main body.

7. The image forming apparatus of claim 2, wherein the first guide comprises:

a lower guide formed proximate to the second guide; and an upper guide pivotably mounted to the lower guide.

8. The image forming apparatus of claim 2, further comprising a reversing roller at a converging point of the first and the second document reversing paths to reverse an advancing direction of the recording medium.

9. The image forming apparatus of claim 2, further comprising a reverse sensor upstream from the converging point of the first and the second document reversing paths to detect a reversing time point of the recording medium.

10. The image forming apparatus of claim 2, further comprising a cooling fan proximate to the document circulation path and/or adjacent to the first and the second document reversing paths to reduce a temperature of the recording medium.

11. The image forming apparatus of claim 10, wherein the cooling fan is disposed at a converging point of the first and the second document reversing paths.

12. The image forming apparatus of claim 11, wherein the second guide comprises:

an air suction port at one side thereof near the converging point through which air is drawn into the image forming apparatus; and an air exhaust port at an opposite side of the second guide to discharge the air.

13. An image forming apparatus, comprising:

a recording medium supply unit, in which recording media are stacked, to sequentially pick up a recording medium and to convey the picked-up recording medium;

an image formation unit to receive the conveyed recording medium and to produce a predetermined image thereon;

a fixing unit to fuse the image to the recording medium by an application of heat and pressure thereto;

a discharge unit to eject the recording medium bearing the fused image from the apparatus;

a selectively mountable duplex printing unit to form a duplex printing document circulation path along which the recording medium, having the image fixed on one side thereof, is circulated so as to be positioned to be reinserted into the image formation unit, wherein the duplex printing unit comprises first and second guides to reinsert the recording medium into the image formation unit;

a main body to house the recording medium supply unit, the image formation unit, the fixing unit, and the discharge unit; and a door, pivotably mounted at one side of the main body, which corresponds to a position of the first guide, wherein the first guide is divided into a lower guide formed proximate to an upper surface of the second guide, and an upper guide pivotably mounted to the lower guide by a hinge shaft.

14. The apparatus according to claim 13, wherein the second guide comprises:

a first document reversing path through which the recording medium, having been conveyed through the duplex printing document circulation path for a predetermined distance, is conveyed; and a second document reversing path to reverse an advancing direction of a trailing end of the recording medium, having been conveyed along the first document reversing path for the predetermined distance, so as to reinsert the recording medium into the image formation unit.

15. The apparatus according to claim 14, further comprising:

a reversing roller to reverse the advancing direction of the recording medium and a reverse backup roller each mounted at a converging point of the first and the second document reversing paths; and a reverse sensor mounted upstream from the reversing roller and the reverse backup roller to detect a reversing time point of the recording medium.

16. The apparatus according to claim 14, wherein the second guide is formed in contact with a lower part of the main body, and the first and second document reversing paths are substantially parallel with a bottom of the main body.

17. The apparatus according to claim 13, wherein the duplex printing unit comprises a printing cover which is rotatably supported at an end thereof, by a hinge shaft to rotate with respect to the duplex printing unit, the first guide comprises first and second feeding rollers, and wherein the duplex printing unit cover comprises first and second backup rollers to correspond to the first and second feeding rollers.

18. The apparatus according to claim 15, further comprising:

a cooling fan, provided adjacent to the converging point, to cool the recording medium; and an air suction port and an air exhaust port provided in the second guide through which air is drawn and exhausted, respectively.

19. The apparatus according to claim 14, further comprising:

a reversing unit to select between causing the recording medium to be conveyed to a discharge path along which the recording medium is ejected from the apparatus and the duplex printing document circulation path; and a plurality of sensors to detect the recording medium being conveyed to thereby check for an occurrence of a jam of the recording medium.

20. The apparatus according to claim 13, wherein, the duplex printing unit comprises a printing cover which is rotatably supported at an end thereof, by a hinge shaft to rotate with respect to the duplex printing unit, and when a jam occurs proximate to the fixing unit, the jam is corrected by a sequential opening of the printing cover, the upper guide, and the door.

21. A selectively mountable duplex printing unit of an image forming apparatus including an image forming unit, to form a document circulation path along which the medium is circulated so as to be positioned to be reinserted into the image formation unit, the selectively mountable duplex printing unit comprising:

a printing cover and a first guide each of which is rotatably supported at respective ends thereof by hinge shafts that define the duplex printing document circulation path as being substantially perpendicular with a bottom of the apparatus;

a second guide to define a first document reversing path through which the medium, having been conveyed along the duplex printing document circulation path for a predetermined distance, is conveyed;

a second document reversing path to reverse an advancing direction of a following end of the medium, having been conveyed along the first document reversing path for the predetermined distance, so as to position the medium to be reinserted; and a reversing roller and a reverse backup roller each mounted at a converging point of the first and the second document reversing paths to automatically reverse the advancing direction of the medium.

* * * * *